United States Patent [19]

Durgan

[11] 3,998,488

[45] Dec. 21, 1976

[54] CONNECTING ELEMENT FOR MOVING MEANS

[75] Inventor: Virgil R. C. Durgan, Tremont, Ill.

[73] Assignee: Caterpillar Tractor Co., Peoria, Ill.

[22] Filed: Apr. 12, 1976

[21] Appl. No.: 676,081

[52] U.S. Cl. ..... 294/67 AA

[51] Int. Cl.[2] ..... B66C 1/24

[58] Field of Search ..... 294/63 R, 67 R, 67 A, 294/67 AA, 67 AB, 78 A, 81 R, 82 R, 86 R, 86 LS

[56] References Cited

UNITED STATES PATENTS

| | | | |
|---|---|---|---|
| 2,165,921 | 7/1939 | Duda | 294/67 A |
| 2,598,730 | 6/1952 | Thompson et al. | 294/67 R UX |
| 3,066,968 | 12/1962 | Brooks | 294/67 AA X |
| 3,239,072 | 3/1966 | Dunbar | 294/67 AA X |
| 3,427,066 | 2/1969 | Kugler | 294/67 R |

FOREIGN PATENTS OR APPLICATIONS

| | | | |
|---|---|---|---|
| 1,093,470 | 5/1955 | France | 294/67 A |

*Primary Examiner*—Johnny D. Cherry
*Attorney, Agent, or Firm*—Frank L. Hart

[57] ABSTRACT

Apparatus for controllably connecting lifting means to an item for moving said item to and from relatively inaccessible locations.

8 Claims, 3 Drawing Figures

CONNECTING ELEMENT FOR MOVING MEANS

BACKGROUND OF THE INVENTION

In the assembling and maintenance of relatively heavyweight machinery, for example crawler type tractors, it is often necessary to move heavy items to and from relatively inaccessible locations. Adjacent structure of the machinery sometimes makes it impossible to remove the item vertically from its location on the machine and/or attach lifting means at a vertically spaced location from the center of gravity of the item. Construction and maintenance of these items therefore requires an undesirable amount of time and labor.

This invention therefore resides in apparatus for controllably connecting lifting means to an item for moving said item to and from relatively inaccessible locations.

DETAILED DESCRIPTION OF THE INVENTION

Figure 1:
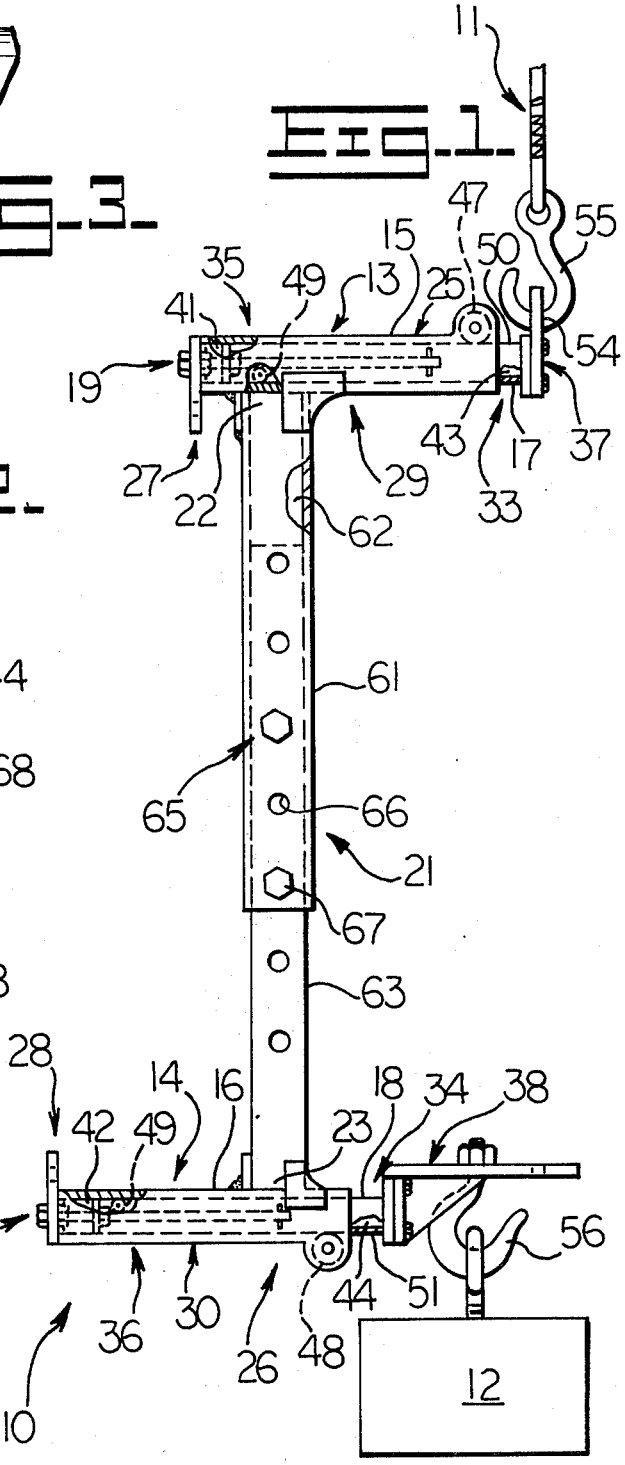
FIG. 1 is a diagrammatic frontal view of the apparatus of this invention.

Referring to FIG. 1, the connecting apparatus 10 of this invention is provided for connecting lift means 11 to an item 12 to be moved to and/or from a relatively inaccessible location.

The apparatus 10 has first and second spaced apart control members 13,14. Each control member 13,14 has a respective frame member 15,16, movable member 17,18, and moving means 19,20, and is connected one to the other by a spacing element 21.

Each of the frame members 15,16 has a first end portion 25,26, a second end portion 27,28, and a middle portion 29,30. The frame members 15,16 are oriented generally parallel relative one to the other with the first end portions 25,26 adjacent one another and oriented in a generally common direction.

Each of the movable members 17,18 has a first end portion 33,34, a second end portion 35,36, and a connecting element 37,38 releasably fixed to the first end portion 33,34. The movable members 17,18 are slidably connected to a respective frame member 15,16 for longitudinal movement therealong.

Each of the moving means 19,20 is connected to the second ends of a respective frame member 15,16 and associated movable member 17,18. The spacing element 21 is connected at a first end 22 to the first frame member 15 and at the second end 23 to the second frame member 16 for maintaining the frame members 15,16 spaced and oriented relative one to the other.

Figure 2:
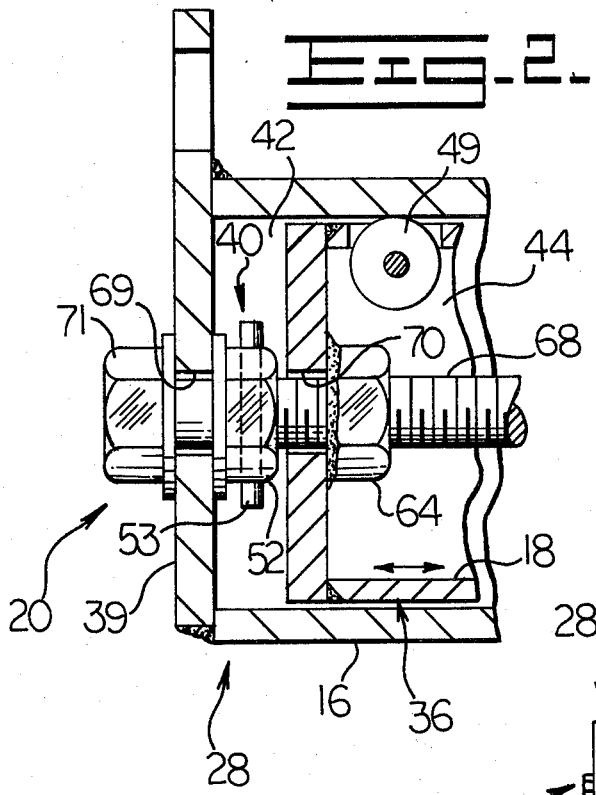
FIG. 2 is a diagrammatic partial sectional view of a portion of the apparatus of FIG. 1.

As better seen in FIG. 2, the frame members 15,16 and movable members 17,18 are preferably each of a generally tubular configuration each having a chamber 41–44. The chambers 41,42 of the frame members 15,16 preferably open at the first end portion 25,26 thereof and the members 15,16 are of dimensions sufficient for insertion of the movable members 17,18 into the respective chambers 41,42 of the frame members 15,16 for slidably connecting the movable members 17,18 to their associated frame members 15,16. The members 15,16 can be of other construction for providing the slidable movement of the movable members 17,18 without departing from this invention.

Referring to FIG. 1, a first roller 47 can be connected to the first end portion 25 of the first frame member 15 in rolling contact with the first movable member 17 along an upper side 50 thereof. A second roller 48 can be connected to the first end portion 26 of the second frame member 16 in rolling contact with the second movable member 18 along a lower side 51 thereof. The rollers 47,48 are preferred for additionally supporting the movable members 17,18 where heavy loads are expected to be moved by the apparatus 10. Additional rollers 49 can be utilized as dictated by the loads expected to be lifted. The rollers also provide smoother movement of the movable members 17,18, less force is required for said movement, and a reduction of wear of the elements, thereby avoiding waste. Where the apparatus 10 is constructed for relatively light loads, grease can be positioned in the annulus between the frame and movable members 15,17 and 16,18, and the rollers 47,48 can be absent.

Figure 3:
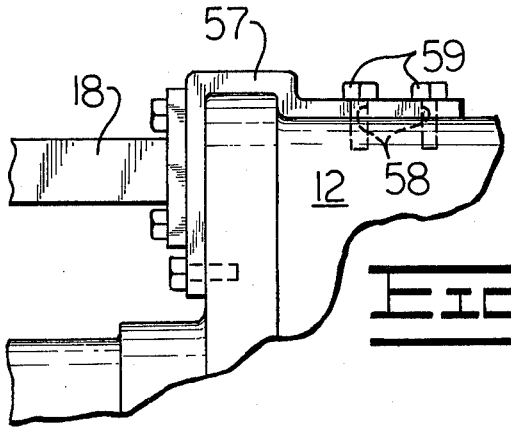
FIG. 3 is a diagrammatic partial view of another embodiment of a connecting element fixed to an item to be moved.

The first connecting element 37 can be a hook eye element 54 connected to the first end portion 33 of the first movable member 17 and being of a construction sufficient for receiving a hook 55 of the lift means 11. The second connecting element 38 can be a hook 56 connected to the first end portion 34 of the second movable element 18.

Where the center of gravity of the item 12 to be moved is laterally spaced from the attachment, the second connecting element 38 can be an adapter bracket 57, as shown in FIG. 3. The adapter bracket 57 has openings 58 therethrough for receiving bolts 59 for connecting the bracket 57 to the item 12. To provide support for the off-center loading, it is preferred that the bracket 57 be of a preselected configuration mateable with the item 12 to be moved.

Referring to FIG. 1, the spacing element 21 can be a unitary element or formed of a plurality of elements adapted for controllably changing the distance between the first and second frame members 15,16. This adjustable feature can be provided by constructing a first element 61 of the spacing element 21 with a chamber 62 opening at the outer end and being connected at the inner end to the first frame member 15. A second element 63 is of a construction sufficient for inserting the second element 63 into the chamber 62 of the first element 61 with the outer end of the second element 63 being connected to the second frame member 16. Means 65, such as openings 66 through the elements 61,63 and bolts 67 extending through the openings 66 can be provided for releasably connecting the elements 61,63 together.

Referring to FIG. 2, the first and second moving means 19,20 can each be of common construction. Referring to moving element 20, a threaded shaft 68 is rotatably connected to the second end portion 28 of frame member 16 and the respective movable member 18 for controllably moving the movable member 18 toward and from the second end portion 28 of the frame member 16 in response to rotating the shaft 68. The second ends of the frame and movable members 16,18 have adjacent openings 69,70 for receiving the shaft 68 and passage of said shaft 68 through the chambers 42,44.

The shaft 68 has an actuating head 71 fixedly connected to a second end of the shaft 68 and positioned on an outer surface 39 of the frame member 16 for rotation by an operator. Means 40, for example nut 52 and pin 53, are associated with the shaft 68 for maintaining the shaft 68 against longitudinal movement relative to the respective frame member 16.

A threaded means 64 is fixedly connected to the respective movable member 18 and is mateable with threads of the shaft 68.

In the operation of the apparatus, the spacing element 21 can be extended or retracted for avoiding contact with structure adjacent the item 12 to be moved. The second connecting element 38 is connected to the item 12 and the item 12 can then be lifted by the lift means 11.

During connection of the second connecting element 38 to the item 12, the second movable member 18 can be extended or retracted to facilitate the connecting operation. Thereafter or prior thereto, the first connecting element 37 can likewise be extended or retracted to align the lifting force over the center of gravity of the item 12. As described above, the movable members 17,18 are extended and retracted by rotating shaft 68.

By so constructing the apparatus of this invention, time and labor can be markedly reduced. Further savings can be made by marking the movable members 17,18 so that the correct positions can be returned to for specific item movement.

Other aspects, objects, and advantages of this invention can be obtained from a study of the drawings, the disclosure, and the appended claims.

What is claimed is:

1. Apparatus for controllably connecting lifting means to an item for moving said item to and from relatively inaccessible locations, comprising:

first and spaced apart tubular frame members each having first and second end portions, a middle portion, and a chamber opening at the first end portion;

first and second tubular movable members each having first and second end portions, and a connecting element positioned on the first end portion, said movable members each being slidably positioned in the chamber of a respective frame member for longitudinal movement therealong;

first and second moving means each connected to a respective frame member and associated movable member for controllably moving the movable member;

a first roller connected to the first end portion of the first frame member in rolling contact with the first movable member along an upper side thereof;

a second roller connected to the first end portion of the second frame member in rolling contact with the second movable member along a lower side thereof; and a spacing element connected at one end to the first frame member and at the other end to the second frame member for maintaining the frame members spaced a preselected distance one from the other.

2. Apparatus, as set forth in claim 1, wherein the first and second moving means each comprises:

a threaded shaft rotatably connected to the second end portions of a frame member and respective movable member; and means for connecting the shaft to the second end portions of said frame member and movable member for controllably moving the movable member toward and from the second end portion of the frame member in response to rotating the shaft.

3. Apparatus, as set forth in claim 2, wherein each movable member has a longitudinally extending chamber, each second end of the frame members and movable members have adjacent openings extending therethrough, and each of said shafts extend through the openings and chambers of the respective frame and movable members.

4. Apparatus, as set forth in claim 3, wherein the connecting means each comprises:

an actuating head fixedly connected to a second end of the shaft and being positioned on an outer surface of a respective frame member;

means for maintaining the shaft against longitudinal movement relative to the respective frame member; and threaded means fixedly connected to the respective movable member and being mateable with the threads of the shaft.

5. Apparatus, as set forth in claim 1, wherein the spacing element is of a construction sufficient for controllably changing the distance between the first and second frame members.

6. Apparatus, as set forth in claim 5, wherein the spacing element comprises:

a first element having a chamber and being connected at one end to the first frame member;

a second element insertable in the first element and being connected to the second frame member; and means for releasably connecting the elements together.

7. Apparatus for controllably connecting lifting means to an item for moving said item to and from relatively inaccessible locations, comprising:

first and second spaced apart frame members each having first and second end portions and a middle portion;

first and second movable members each having first and second end portions, said movable members each being slidably positioned in a respective frame member for longitudinal movement therealong;

first and second moving means each connected to a respective frame member and associated movable member for controllably moving the movable member;

a spacing element connected at one end to the first frame member and at the other end to the second frame member for maintaining the frame members spaced a preselected distance one from the other;

a hook eye element connected to the first end portion of the first movable member; and a hook connected to the first end portion of the second movable member.

8. Apparatus for controllably connecting lifting means to an item for moving said item to and from relatively inaccessible locations, comprising:

first and second spaced apart frame members each having first and second end portions and a middle portion;

first and second movable members each having first and second end portions, said movable members each being slidably positioned in a respective frame member for longitudinal movement therealong;

first and second moving means each connected to a respective frame member and associated movable member for controllably moving the movable member;

a spacing element connected at one end to the first frame member and at the other end to the second frame member for maintaining the frame members spaced a preselected distance one from the other;

a hook eye element connected to the first end portion of the first movable member; and a bracket having openings therethrough and being connected to the first end portion of the second movable member and of a preselected configuration mateable with an item to be moved.

* * * * *